US007203976B1

(12) United States Patent
Weller et al.

(10) Patent No.: US 7,203,976 B1
(45) Date of Patent: Apr. 17, 2007

(54) FLOOR LEVEL WASTE PUMPING SYSTEM FOR TOILETS

(75) Inventors: Paul A. Weller, Louisville, KY (US); Thomas J. Burch, Jr., Louisville, KY (US); Kenneth E. Zoeller, deceased, late of Louisville, KY (US); by Monica Henderson, legal representative, Louisville, KY (US)

(73) Assignee: Zoeller Company, Louisville, KY (US)

( * ) Notice: Subject to any disclaimer, the term of this patent is extended or adjusted under 35 U.S.C. 154(b) by 258 days.

(21) Appl. No.: 10/893,408

(22) Filed: Jul. 16, 2004

(51) Int. Cl.
*E03D 1/00* (2006.01)

(52) U.S. Cl. ..... 4/321; 4/322; 4/323; 4/315

(58) Field of Classification Search ..... 4/321–323, 4/315, 346, 342; 241/21
See application file for complete search history.

(56) References Cited

U.S. PATENT DOCUMENTS

| | | | | | |
|---|---|---|---|---|---|
| 2,676,666 | A | * | 4/1954 | Howe | 210/111 |
| 3,570,018 | A | | 3/1971 | Sargent et al. | |
| 3,582,995 | A | | 6/1971 | Enenstein | |
| 3,597,768 | A | | 8/1971 | Wofford | |
| 3,673,614 | A | * | 7/1972 | Claunch | 4/320 |
| 3,939,499 | A | * | 2/1976 | Roberts | 4/321 |
| 4,377,875 | A | | 3/1983 | Brubakken | |
| 4,653,128 | A | | 3/1987 | Canalizo | |
| 4,704,747 | A | | 11/1987 | Brubakken et al. | |
| 4,947,491 | A | | 8/1990 | Parkinson et al. | |
| 5,036,554 | A | * | 8/1991 | Blount | 4/323 |
| 5,038,418 | A | | 8/1991 | Frey | |
| 5,913,610 | A | * | 6/1999 | Duck | 4/321 |
| 5,931,642 | A | * | 8/1999 | Friedman et al. | 4/431 |
| 5,983,411 | A | | 11/1999 | Demoret | |
| 6,038,710 | A | | 3/2000 | Baron | |
| 6,094,752 | A | | 8/2000 | Loshaw | |
| 6,129,117 | A | | 10/2000 | Eriksson | |
| 6,343,752 | B1 | * | 2/2002 | Sleasman et al. | 241/21 |
| 6,430,757 | B1 | | 8/2002 | Pohler | |
| 2004/0094276 | A1 | * | 5/2004 | Perini | 241/21 |

OTHER PUBLICATIONS

"Saniplus" system, SFA Saniflow, Inc. Pumping Systems, computer printout accessed Feb. 16, 2004.

* cited by examiner

*Primary Examiner*—Khoa D. Huynh
(74) *Attorney, Agent, or Firm*—Scott R. Cox

(57) ABSTRACT

A floor level pumping system, that is non-disruptive to the existing flooring, including a conventional rear outlet toilet, a floor level tank for receiving waste and fluid from the outlet of the toilet including a tank chamber containing a designated area with a sensing system which activates a discharge pump when the level or quantity of the waste and fluid within the tank chamber reaches a predetermined level, wherein the chamber further includes one or more baffles extending upward from a floor of the tank chamber, which baffles at least partially segregate the designated area from the remaining area of the tank chamber, wherein at least one of said baffles contains a curved surface, and a discharge pump for pumping waste from the floor level tank out through a discharge pipe, wherein the discharge pump is secured to the floor level tank.

24 Claims, 9 Drawing Sheets

FLOOR LEVEL WASTE PUMPING SYSTEM FOR TOILETS

CROSS REFERENCE TO RELATED APPLICATIONS

None

BACKGROUND OF INVENTION

The present invention relates to a self-contained, floor level waste collection and disposal system for toilets and a discharge pump specifically designed for use with that floor level waste collection and disposal system for toilets.

Self-contained, floor level waste collection and disposal units for toilets have particular utility for bathrooms in locations not easily modified for use with below floor level piping commonly utilized with bathroom fixtures. For example, such units are particularly useful when a bathroom is added to an existing basement or to an existing concrete slab. Because of the difficulty in construction as well as the expense associated with installation of below floor level bathroom piping in these circumstances, these self-contained, floor level bathroom facilities, along with the piping utilized therewith, are necessarily located above the level of the floor or concrete slab.

Conventional self-contained, floor level bathroom waste collection and disposal units for toilets include a conventional toilet, secured on top of a floor level tank for receipt of waste from the toilet as shown, for example, in U.S. Pat. No. 6,430,757. While such self-contained, floor level toilet facilities can be useful, certain inherent disadvantages exist because of the requirement that the toilet itself be located above floor level on top of the waste collection tank.

A design for a waste collection and disposal system, which is located behind the toilet, is disclosed by SFA Saniflo, Inc. Pumping Systems and is referred to as the "Saniplus" system. The "Saniplus" system utilizes a specially designed toilet basin containing a rear discharge outlet located in a position that is significantly higher than is utilized by conventional, rear discharge toilets. This added height to the discharge outlet increases the volume of waste that can be received in the waste collection tank during each flushing cycle. The pump that is utilized with the "Saniplus" system to discharge the waste from the waste collection tank is a conventional, macerating pump, which merely pumps the waste out through discharge piping without further processing of the waste. This pump is located within the waste collection tank, making repair of that pump inconvenient.

Notwithstanding the presence of existing, above floor level toilet systems, a need still exists to provide an improved floor level bathroom waste collection and disposal tank which operates efficiently with a conventional, rear outlet toilet. There is a further need for a specially designed, floor level waste discharge tank, which encourages the flow of bathroom waste from the inlet opening in the tank to a grinding and pumping system for grinding the bathroom waste prior to its discharge to an outside facility. There is also a need for a floor level, waste discharge tank for receiving waste from a conventional, rear outlet toilet which is both lightweight and mechanically strong, yet contains handling features permitting easy transportation and installation. It has also been discovered that the pump and motor for this system should be placed at a location that is easily accessible for servicing.

The objects and features of the present invention mentioned throughout the application will become apparent to those skilled in the art from a consideration of the following detailed description, drawings and claims. The description, along with the accompanying drawings, provides a selected example of construction of the device to illustrate the invention but does not place a limitation on the scope of the claims of the invention.

SUMMARY OF THE INVENTION

The present invention provides a floor level pumping system for toilets (10), that is non-disruptive to the existing flooring, comprising a rear outlet toilet (20); a floor level tank (30) for receiving fluid and waste from an outlet (22) of the toilet (20) along with wastewater from standard bathroom fixtures, such as sinks and showers, comprising a tank chamber (31) containing an area (44) where the level or quantity of fluid and waste within the tank (30) is sensed, wherein contained in that area (44) is a sensing system which activates a discharge pump (100) when the volume, pressure and/or quantity of fluid and waste within the tank chamber (31) reaches a predetermined level, wherein the tank chamber (31) further comprises one or more baffles (53) extending upward from a floor (40) of the tank chamber (31), which baffles (53) at least partially segregate the area (44) from the remaining area within the tank chamber (31), and a discharge pump (100), designed for pumping waste from the floor level tank (30) through a discharge pipe (96), wherein the discharge pump (100) is secured to the floor level tank (30).

In a preferred embodiment, the floor (40) of the tank chamber (31) gradually descends from its level at the outlet (22) of the toilet (20) to a lower level at the discharge pump (100).

In a further preferred embodiment, the floor (40) of the tank chamber (31) gradually descends from its level at the outlet (22) by use of a series of descending steps (50).

In a further preferred embodiment, the discharge pump (100) includes a cutter (92) for cutting up waste discharged into the tank chamber (30) from the rear outlet toilet (20).

In a further preferred embodiment, the discharge pump (100) includes an discharge opening (94) through which a flow of fluid is pumped under pressure from the discharge pump (100) toward the baffles (53) contained in the floor level tank (30).

In a further preferred embodiment, a substantial portion of the discharge pump (100) is secured to the floor level tank (30) at a location outside of the tank chamber (31).

BRIEF DESCRIPTION OF THE DRAWINGS

A better understanding of the present invention is provided by the description in the accompanying drawings.

DETAILED DESCRIPTION OF THE PREFERRED EMBODIMENT

Figures 1, 2:
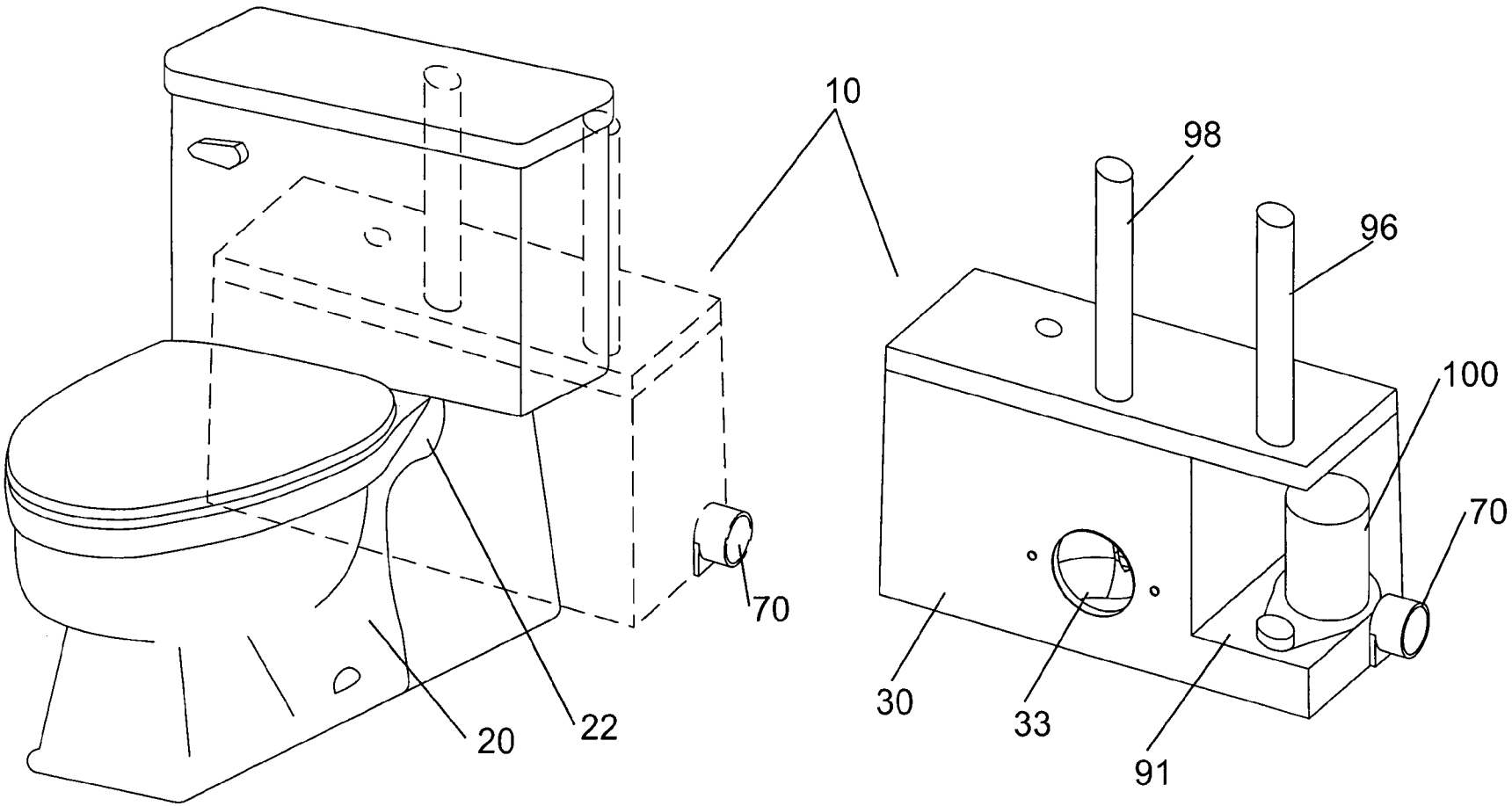
FIG. 1 is a perspective view of the floor level pumping system with toilet.
FIG. 2 is a perspective view of the floor level pumping system without the toilet.

Referring to FIG. 1, there is shown a floor level pumping system (10) for the collection and disposal of bathroom waste from a toilet (20). Typically, floor level toilet systems (10) of this type are utilized in a basement or other location where a conventional toilet system, which relies on gravity to provide drainage and contains below floor level piping, cannot easily be installed.

The floor level pumping system (10) of the invention generally includes a conventional, rear outlet toilet (20). Bathroom waste from the rear outlet toilet (20) pass through a rear outlet (22) of the toilet into a floor level tank (30) as shown in FIG. 2.

Figure 3:
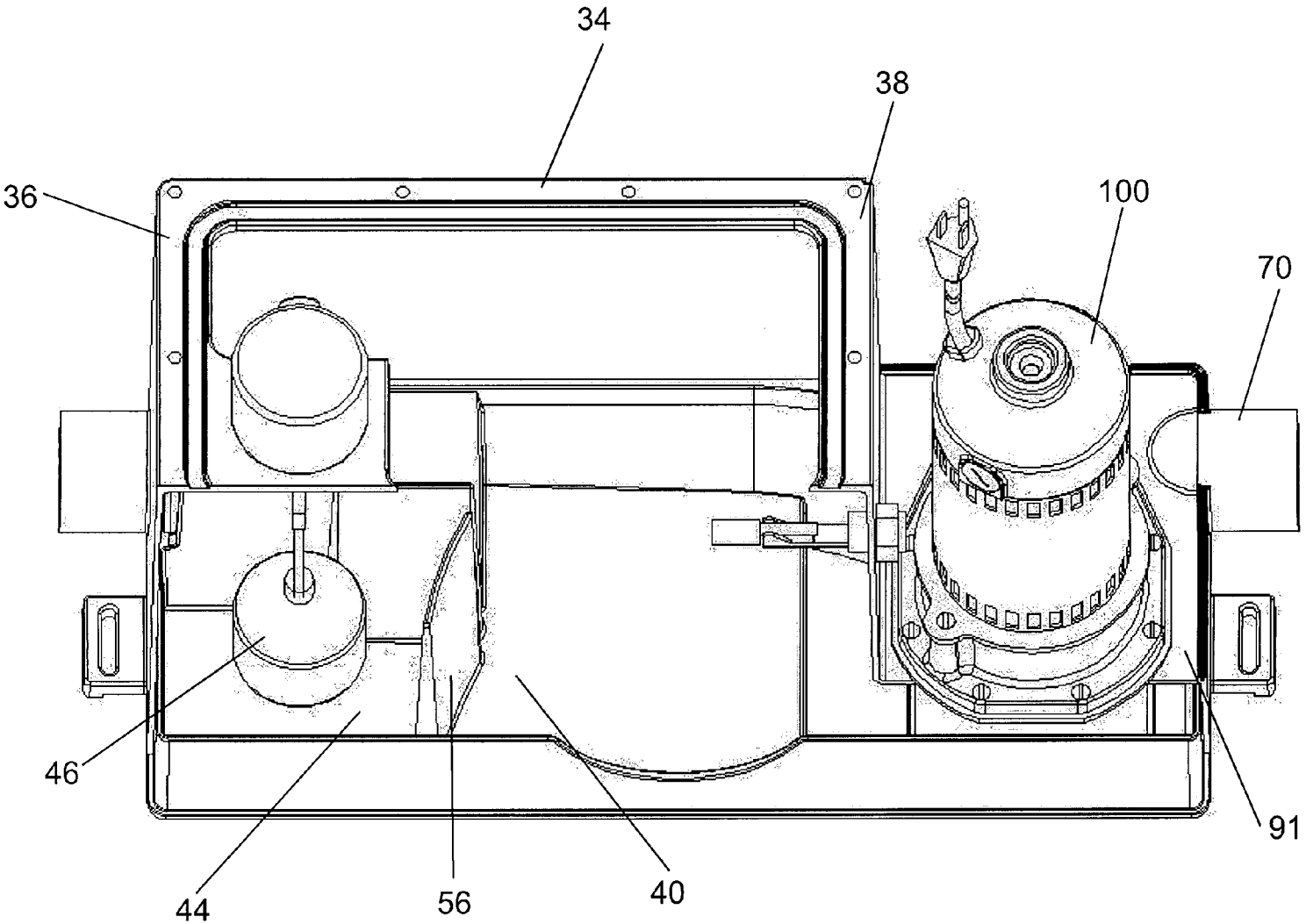
FIG. 3 is a front cutaway perspective view of the floor level tank showing the tank chamber and a discharge pump.
Figure 4:
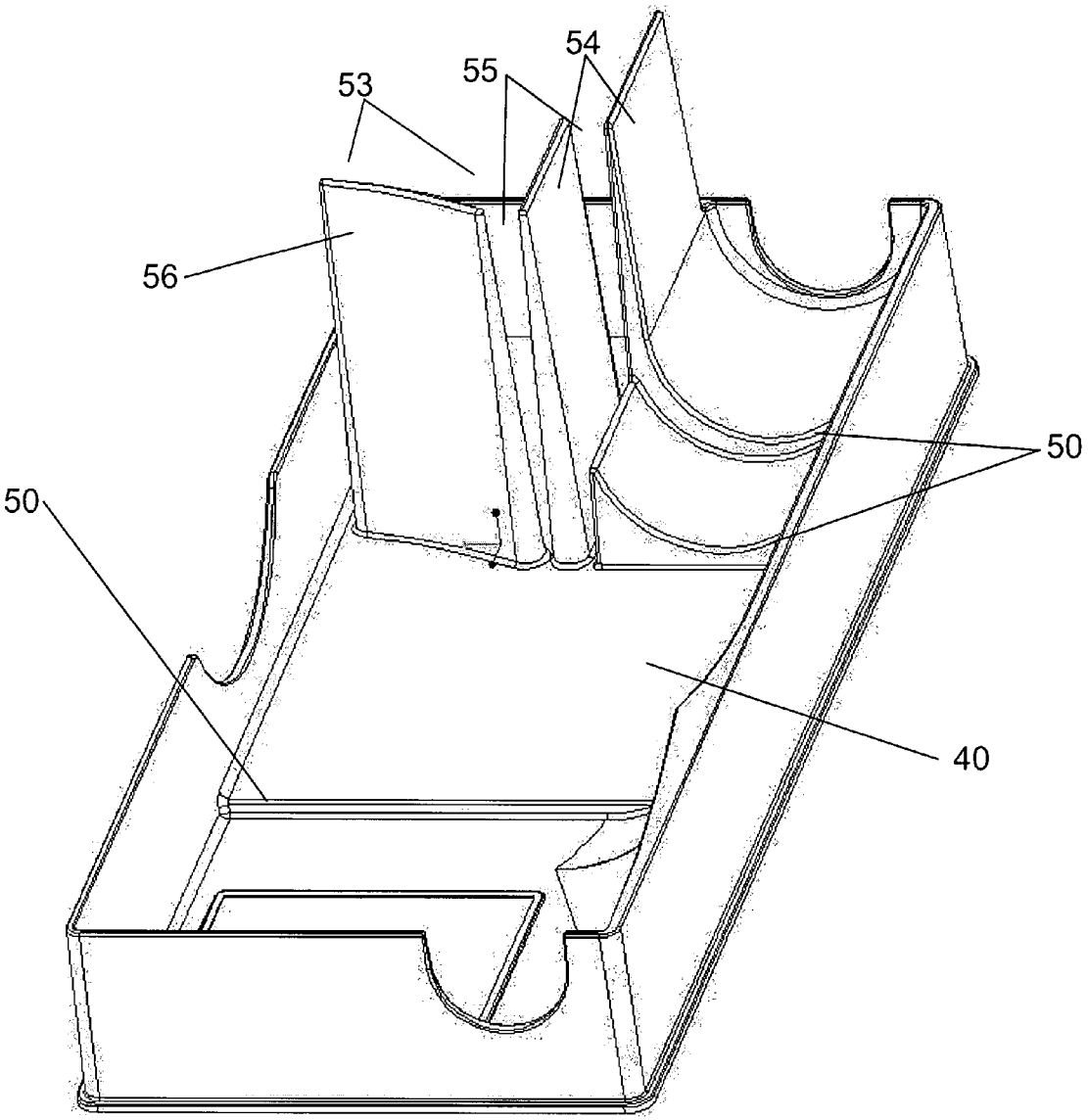
FIG. 4 is a side cutaway perspective view of the tank chamber showing particularly the bottom of the discharge tank with baffles.
Figure 5:
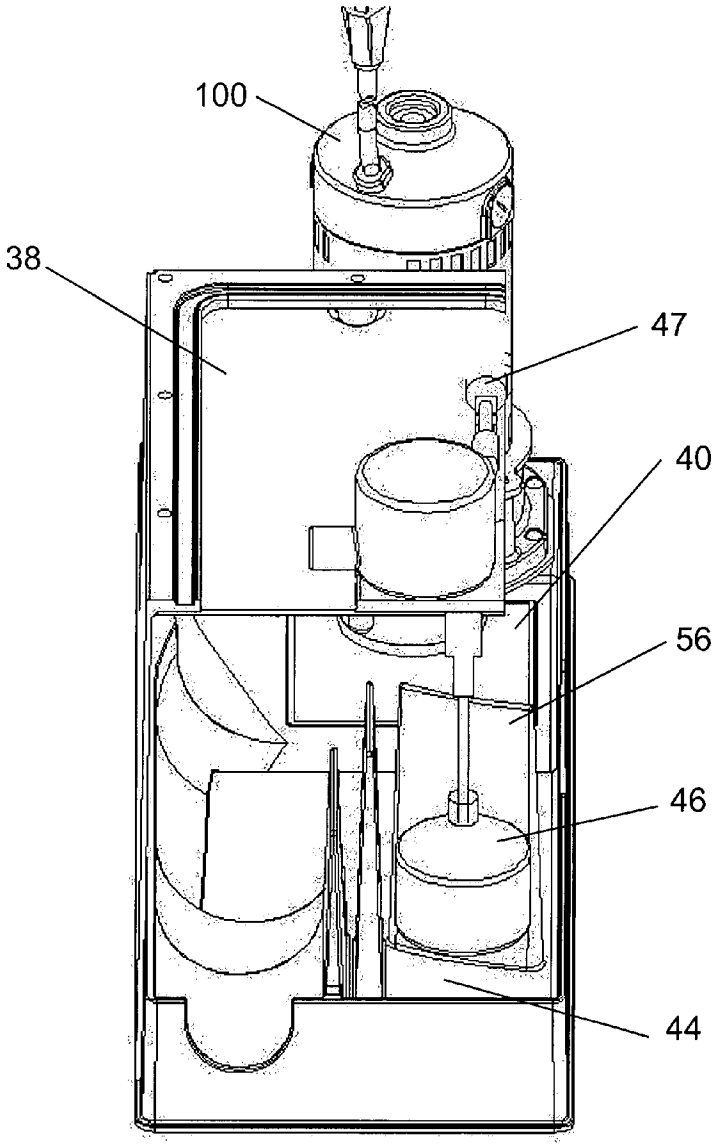
FIG. 5 is an end cutaway, perspective view of the tank chamber.
Figure 6:
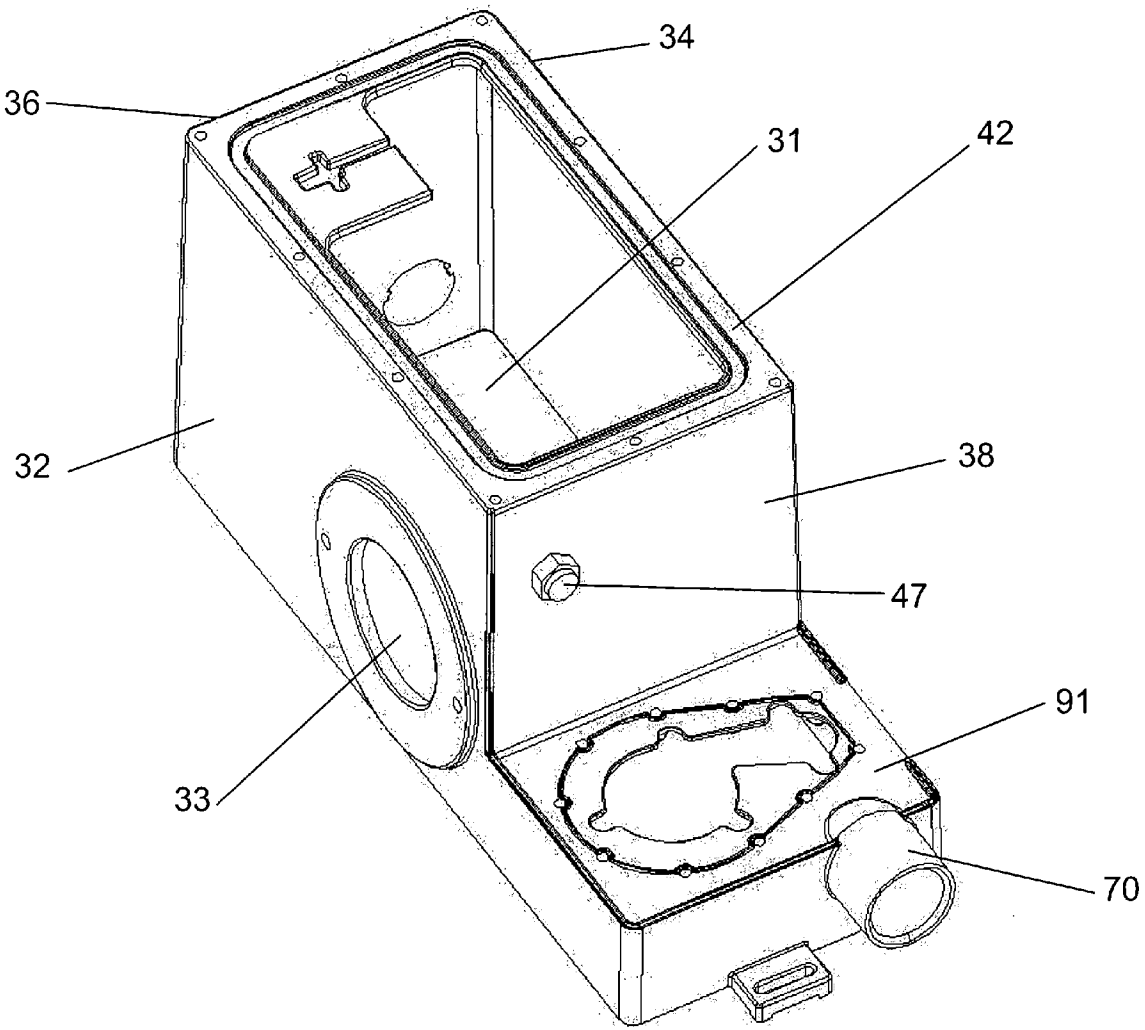
FIG. 6 is a perspective view of the tank body which is a component of the floor level tank.

The floor level tank (30) is generally comprised of a tank floor (40) or bottom, as shown in FIGS. 3, 4 and 5, and a tank body (42), as shown in FIG. 6. These components are joined hermetically to create the floor level tank (30). The floor level tank (30) includes the tank body (42) which contains a front side (32), back side (34), left side (36), right side (38) and floor (40), as shown in FIGS. 3 and 6. These components are manufactured of conventional materials commonly utilized in bathroom fixtures.

Waste and fluid from the rear outlet toilet (20) flows into the tank chamber (31) through an opening (33) in the front side (32) of the tank chamber (31) as shown in FIG. 2. The precise location of the opening (33) in the front side (32) of the tank chamber (31) is important as it is designed to permit it to accommodate conventional, rear outlet toilets (20). This opening (33) is located quite low in the front side (32) of the tank chamber (31), preferably about 4 inches from the bottom edge of the tank chamber (31) to the center of the opening (33). By placing this opening (33) at this specific location, the floor level pumping unit (10) of the invention can be connected to a conventional rear outlet toilet (20). In contrast, above floor level toilet systems, such as the "Saniplus" system, require the use of custom-made toilets with rear outlets located at higher elevations on the tank chamber. Because the opening (33) is located low on the front side (32) of the tank chamber (31), as shown in FIG. 2, the floor level pumping unit (10) must evacuate the bathroom waste efficiently and quickly.

Figure 10:
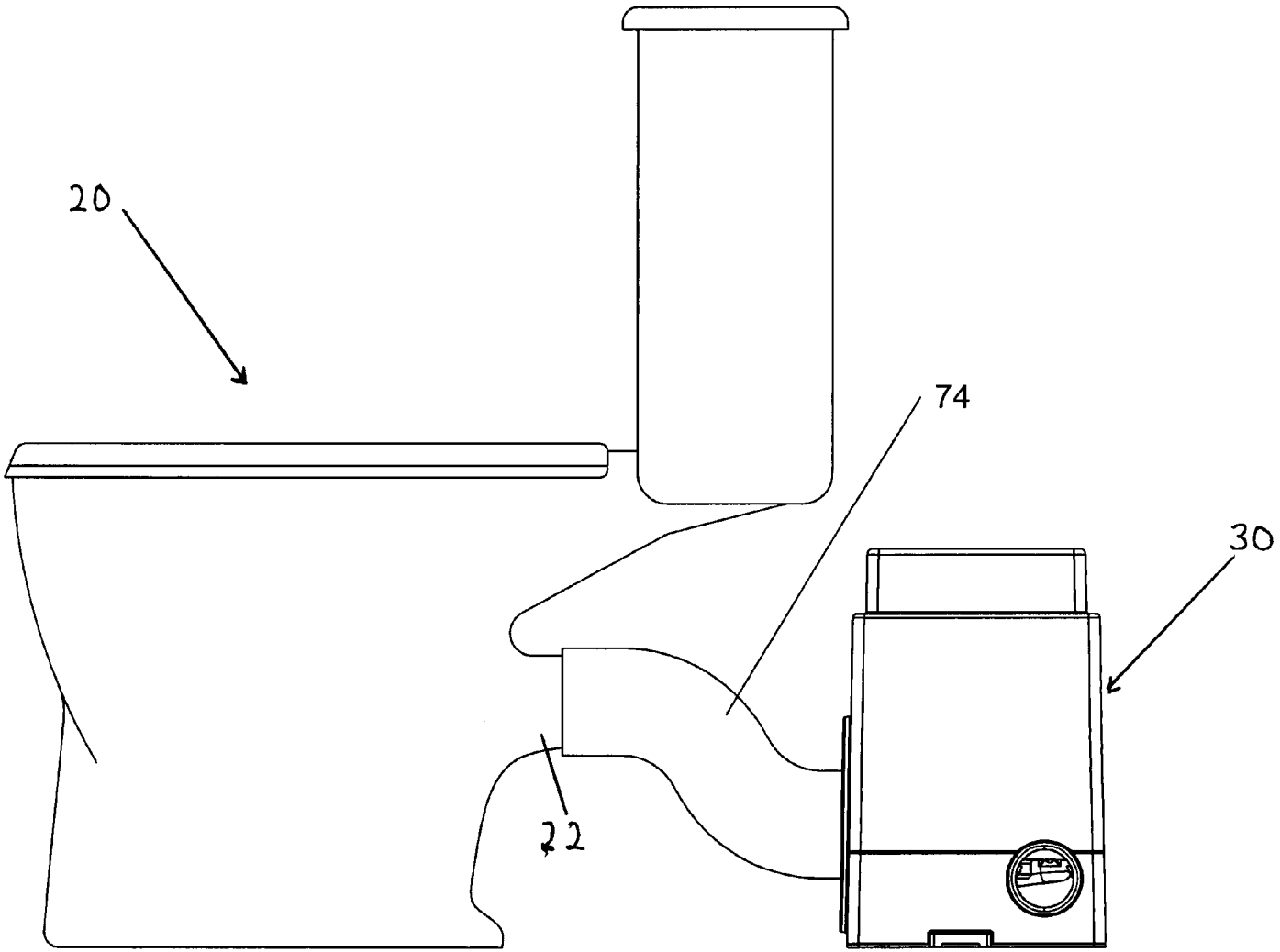
FIG. 10 is a side view of the floor level pumping system containing an adjustable attachment piping to connect the toilet to the floor level tank.

In an alternative embodiment, there can be attached to the opening (33) by conventional attachment systems an adjustable attachment piping (74), which is adapted to fit on toilets with rear outlets that are at various heights. This adjustable attachment piping (74) may be comprised of conventional materials which can by attached securely to both the rear outlet (22) of the toilet (20) and the opening (33) in the front side (32) of the tank chamber (31), as shown in FIG. 10.

The efficient evacuation of bathroom waste is encouraged by the unique design of the tank chamber (31). To encourage the flow of the waste away from the opening (33) in the front side (32) toward the discharge pump (100), the floor (40) gradually descends from the side (36) of the tank chamber (31) located furthest from the discharge pump (100) to the discharge pump (100) itself, as shown particularly in FIG. 4. The angle of descent of the floor is not critical, but is preferably at least about 2°–5° or so. In a further preferred embodiment, the floor (40) of the tank chamber (31) is constructed in a series of descending steps (50), descending from the side of the tank chamber (31) furthest from the discharge pump (100) toward the discharge pump (100), as shown in FIGS. 3 and 4. Each of these steps (50) is located slightly lower in the tank chamber (31) than the preceding step, preferably at least about ¼ of an inch lower. This system of descending steps (50) in the floor (40) encourages the flow of the bathroom waste toward the discharge pump (100). In addition, the descending steps (50) discourage back flow of bathroom waste away from the discharge pump (100), as backflow of that waste would require flow not only uphill, but also up over the edges of each succeeding higher step (50).

Another improvement in the floor level tank (30) of the invention is the use of a plurality of vertical baffles (53) located in the tank chamber (31), as shown in FIGS. 3–5. These baffles (53) extend upward from the floor (40) of the tank chamber (31). The baffles (53) are preferably about 2 to about 8 inches in width and may extend upward to the top of the tank chamber (31). In a preferred arrangement the baffles (53) are located in a stepped arrangement, as shown in FIGS. 4 and 5, wherein at least a portion of the baffle furthest from the discharge pump (100) is located in a position closer to the back side (34) of the tank chamber (31) than the next succeeding baffle, wherein the portion of the baffle closest to the next succeeding baffle preferably slightly overlaps the next baffle. In a preferred arrangement a narrow opening (55), preferably about ¼ inch or so in width, is provided between each succeeding baffle (53) where the baffles overlap, as shown in FIGS. 4 and 5. The distance between the baffles (53) may increase from the bottom of the baffles (53) upward as shown in FIG. 4. This arrangement of the baffles permits wastewater to flow into a designated area (44) within the tank chamber (31) to raise the level and quantity of waste in that area (44) sufficiently to activate a system contained in that area (44) which activates the discharge pump (100). This openings (55) also permit solid material and liquids, located in the designated area (44) of the tank outlined by the baffles (53) and the sides of the tank chamber (31), which area contains the system for activating the pump (100), to pass between the baffles (53) toward the discharge pump (100). In a particularly preferred embodiment, the baffle located closest to the discharge pump (100) and the front side (32) of the tank chamber (31), is a curved baffle (56), curving toward the side of the tank (30) containing the discharge pump (100) away from the other baffles (54), as shown in FIG. 4. The extent of the curvature of the curved baffle (56) can vary depending upon various factors, including the size of the tank chamber (31) and the overall width of the curved baffle (56). In one preferred embodiment a radius of the curved baffle (56) is from about 7–8". By use of this curved baffle (56), bathroom waste, as it enters the tank chamber (31) through the opening (33) in the front side (32), is encouraged to flow along the floor (40) of the tank chamber (31) to the next lower step (50) of the floor (40) toward the discharge pump (100). While the use of a single curved baffle (56) is preferred to assist in the flow of the waste, an alternative embodiment would utilize only non-curved baffles (54). In addition, any number of baffles (53) from one (1) to four (4) or more may be used.

The number of baffles (53), their specific location and shape can be modified to assist in a more efficient flow of the waste from the rear outlet toilet (20) through the opening (33) in the floor level tank (30) toward the discharge pump (100). In one preferred embodiment, three or more of the baffles (53) are provided, each with a width that may be slightly greater than the width of the individual steps (50) located at the bottom of the tank chamber (31), as shown in FIG. 4. The height of the individual baffles (53) should be sufficient so that waste which enters the tank chamber (31) cannot flow over the top of the baffles (53). Thus, the height of the baffles (53) should be at least as high as the top of the rear outlet (22) of the rear outlet toilet (20). The baffles (53) may be constructed of any sturdy material and preferably are constructed of the same material as is the floor level tank (30).

The designated area (44) within the floor level tank (30) is preferably formed by the non-curved baffles (54), the curved baffle (56) and the left side (36) and the front side (32) of the tank (30) as shown in FIGS. 3 and 5. This area (44) contains a sensing system which senses a volume, pressure, level and/or quantity of waste and/or fluid within the tank chamber (31). In one preferred embodiment the sensing system is a float system (46) which controls activation of the discharge pump (100). The float system (46) is conventional in design and operation. In an alternative embodiment, instead of using a conventional float system (46), any known fluid sensing system that senses the volume, pressure, level or quantity of waste and/or fluids within the tank chamber (31) can be used, such as an electronic probe (not shown) for sensing the volume of fluid within the tank chamber (31).

The baffles (53) are placed in a location within the tank chamber (31) which protects the designated area (44) and the float system (46), or other sensing system, from build up of solid waste discharged from the rear outlet toilet (20). This area (44) is preferably located on the highest step (50) on the floor (40) of the tank chamber (31). By locating the area (44) with the sensing system on the upstream side of the opening (33) in the front side (32) of the floor level tank (30), the pattern of flow of the bathroom waste, entering the opening (33) in the front side (32) of the floor level tank (30), is directed away from the sensing system toward the discharge pump (100). This flow of the bathroom waste away from this area (44) toward the discharge pump (100) also creates a suction effect within the tank (30) which draws liquid and solid effluent that may be contained in the area (44) through the openings (55) between the baffles (53) toward the discharge pump (100).

The floor level pumping system (10) may also include components which activate an alarm (47) when the level of fluid within the tank is excessively high as shown in FIG. 5. For example, a high water alarm such as the Flood Alert®, produced by Zoeller Company, can be placed within the tank chamber (31). Appropriate electrical connections can be made to the high water alarm (47) to provide electricity for the operation of the system.

The floor level pumping system (10) of the invention can also be used to receive and pump fluids from other locations within the bathroom, such as from showers and water faucets. Fluids from these other sources preferably enter the tank chamber (30) through side inlets (70), as shown in FIGS. 3, 4 and 5. In particular, when the fluid flow is from a side inlet (70) located on the side (36) of the tank chamber (31) furthest from the discharge pump (100), the design of the floor (40) of the tank chamber (31) encourages the flow of those fluids toward the discharge pump (100). In a preferred embodiment the floor (40) near this side outlet (70) is curved, as shown in FIG. 4, to assist in prevention of the build of solids in that portion of the tank chamber (31) and also to assist in the overall flow of the effluent.

Figure 8:
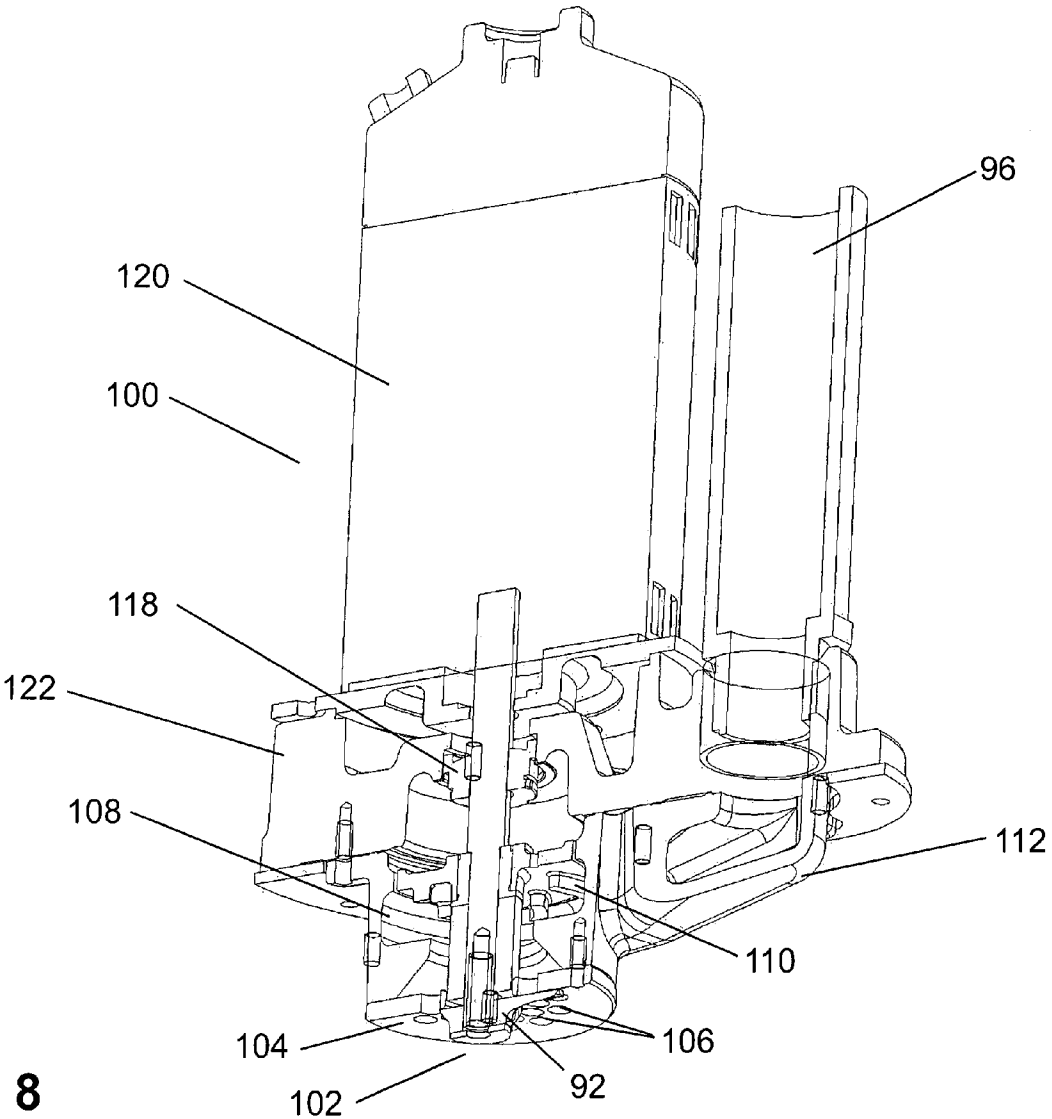
FIG. 8 is a cutaway perspective view of the discharge pump of the system.
Figure 9:
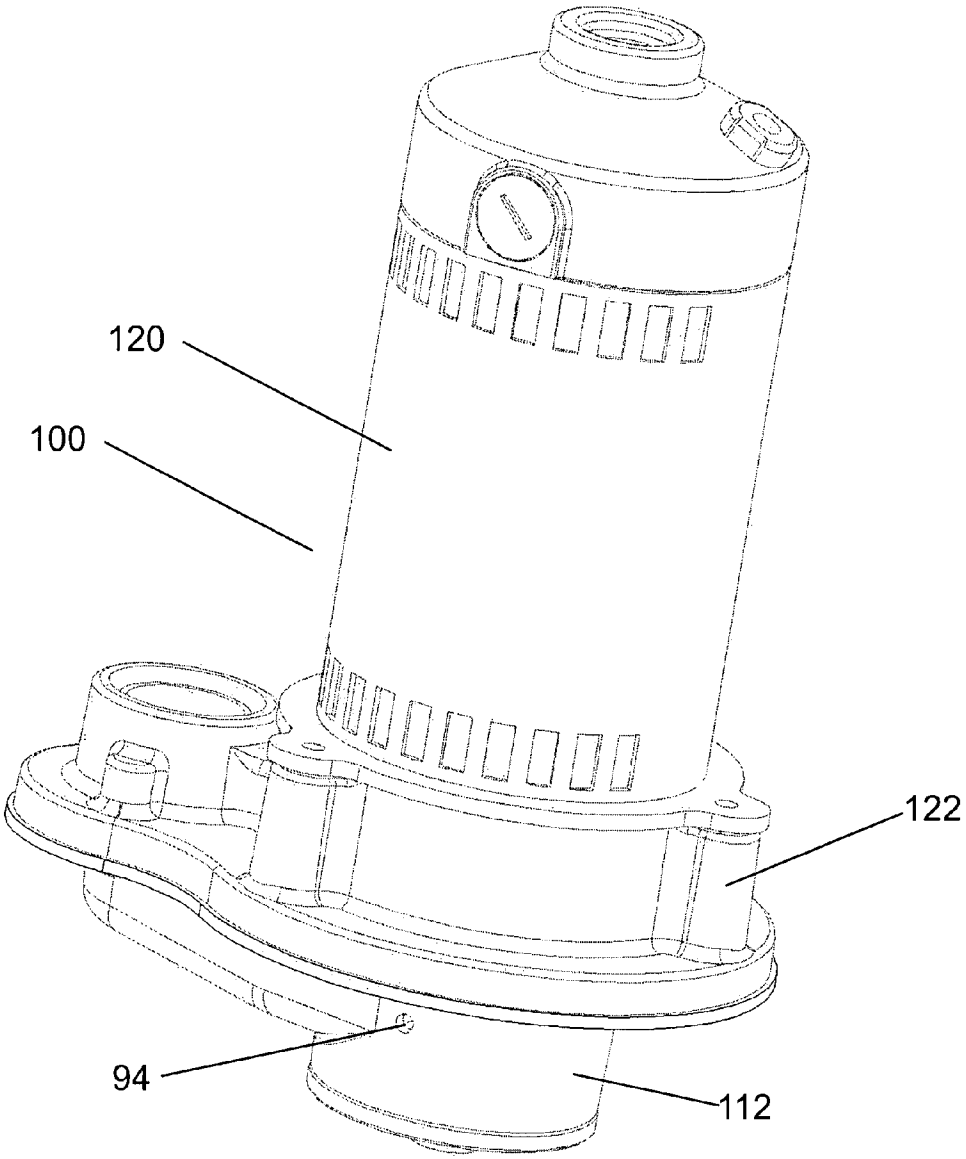
FIG. 9 is a perspective view of the discharge pump showing particularly the discharge opening.

The preferred discharge pump (100) includes a brush motor (120), pump housing (122), base (112), impeller (110), cutter (92), and cutter plate, (104) as shown in FIG. 8. This pump (100) also contains a mechanical seal (118) capable of sealing the pump (100) even if operated at high speeds, preferably greater than 5000 rpm, and can withstand sustained periods of dry run. The pump (100) utilizes the cutter (92) at the pump inlet (102) to grind solids against the cutter plate (104). The cutter plate (104) contains a series of holes (106), preferably approximately ¼" in diameter. These holes (106) serve the purpose of ensuring that solids have been ground small enough to enter a pump chamber (108). They also allow fluid to enter the pump chamber (108). The impeller (110) in the pumping chamber (108) then pumps the wastewater and ground solids out through the discharge pipe (96).

The pump (100) is mounted to the tank (30) as shown in FIGS. 2 and 3 such that its base (112) and cutter (92) are located below the mounting surface (91). A discharge opening (94) is preferably located in the base (112) of the pump (100). This discharge opening (94) prevents the pump from air locking and also produces a jet stream of fluid to assist in the flow of effluent within the tank chamber (31). This discharge opening (94) is preferably designed to expel fluid from the discharge pump (100) under pressure toward the curved baffle (56). Fluid from this discharge opening (94) when it hits the curved baffle (56) creates a flow pattern back around the curved baffle (56) toward the discharge pump (100), thereby creating a swirling action within the tank chamber (31) encouraging the flow of waste toward the discharge pump (100). This flow pattern created by the discharge of fluid from the discharge opening (94) also creates a suction effect, drawing fluid away from the area (44) through the openings (55) between the baffles (53). This helps keep the area (44) clean from solid waste.

Figure 7:
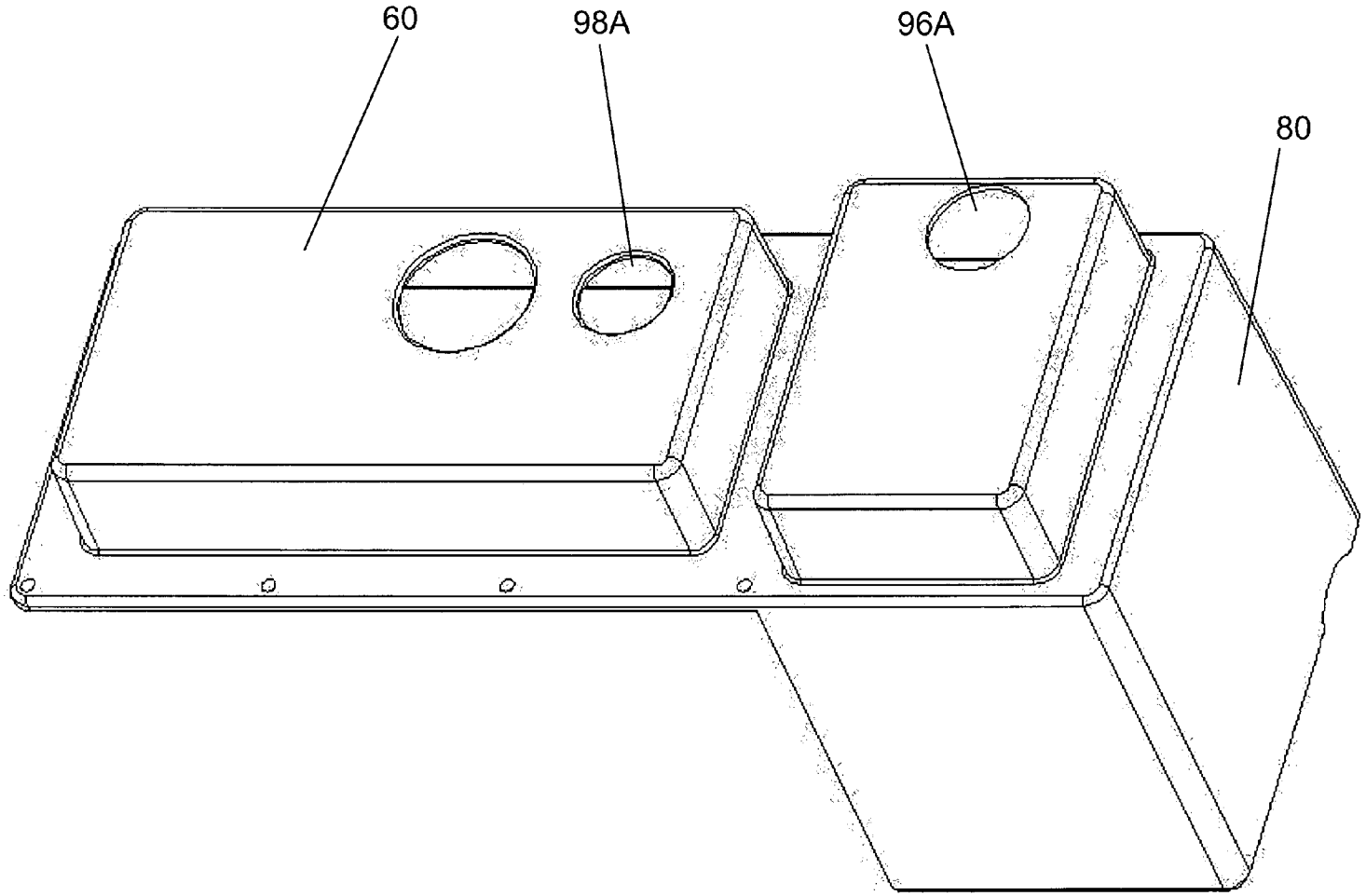
FIG. 7 is a perspective view of the tank lid including a pump cover for the discharge pump.

The tank (20) is covered by the tank cover (60) which incorporates a pump cover (80) as shown in FIG. 7. When repairs are necessary to the discharge pump (100), easy access is available to the pump (100) merely by removal of the tank cover (60) and pump cover (80). Because the discharge pump (100) is located outside of the tank chamber (31), access to the discharge pump (100) for repairs is relatively easy.

The tank cover (60) is placed on top of the tank (30) and pump (100), as shown in FIG. 2. The tank cover (60) includes an opening (98A) for a vent pipe (98), which vents gases contained within the floor level pumping system (10). The tank cover (60) also includes an opening (96A) for the discharge pipe (96) and may include other openings for other desired purposes.

In operation, bathroom waste from the rear outlet toilet (20) is discharged through its rear outlet (22) through an opening (33) in the front side (32) of the floor level tank (30). Upon entering the tank chamber (31) of the floor level tank (30), the bathroom waste encounters baffles (53), including non-curved baffles (54) and a curved baffle (56), which encourage the flow of the bathroom waste toward the discharge pump (100). Further encouragement for this flow pattern is provided by the gradually descending levels of the floor (40) of the tank chamber (31). In addition, back flow of the bathroom waste is discouraged because of steps (50) provided in the floor (40) of the tank chamber (31). Flow in the preferred pattern is further encouraged by liquid expelled under force through the discharge opening (94) in the discharge pump (100) once the pump has been activated.

Flow from the discharge pump (100) interacts with the curved baffle (56). Once the level of the fluid in the area (44) of the floor level tank (30) reaches a predetermined height, the float system (46) activates the discharge pump (100). The bathroom waste enters the discharge pump (100) where it is ground up by use of the blade cutter (92) of the discharge pump (100) and is discharged through the discharge pipe (96) to an above-grade piping system by the pumping action of the impeller (110).

The foregoing detailed description is provided for understanding and does not provide any limitation on the scope of the claims. Modifications to the invention will be obvious to those skilled in the art upon a review of the disclosure without departing from the scope of the appended claims.

We claim:

1. An above floor level pumping system comprising a rear outlet toilet containing a rear outlet, which toilet is located on the floor, an above-floor level tank for receiving fluid and waste from the rear outlet of the toilet comprising a tank chamber containing a designated area containing a sensing system designed to sense fluid or waste within the tank chamber, which system is capable of activating a discharge pump, wherein the tank chamber further comprises a baffle extending upward from a floor of the tank chamber, which baffle at least partially segregates the area containing the sensing system from the remaining area within the tank chamber, and the discharge pump for pumping fluid or waste from said floor level tank through a discharge pipe, wherein the discharge pump is secured to the floor level tank, wherein the level of the floor of the tank chamber descends as it approaches the discharge pump, and wherein the floor of the tank chamber further comprises a series of descending steps, wherein the above-floor level tank is located behind the rear outlet toilet and on the floor, wherein the toilet is not on top of the tank, and wherein the rear outlet toilet and the above-floor level tank are both supported by the floor and do not disrupt the floor.

2. The system of claim 1 wherein the fluid sensing system comprises a float system contained within the designated area within the tank chamber.

3. The system of claim 1 wherein the baffle contains a curved surface.

4. The system of claim 1 wherein at least one curved baffle and at least one non-curved baffle are present in the tank chamber.

5. The system of claim 1 further comprising at least two baffles which overlap are present within the tank chamber.

6. The system of claim 1 wherein the discharge pump contains a cutter to grind solids contained in the fluid and waste.

7. The system of claim 1 wherein the discharge pump contains a discharge opening through which a flow of fluid is discharged into the tank chamber.

8. The system of claim 1 wherein the discharge pump is secured to the floor level tank outside of the tank chamber.

9. The system of claim 1 wherein the tank chamber further comprises a tank chamber opening wherein said tank chamber opening is connected to a rear outlet of the rear outlet toilet by adjustable attachment piping.

10. The system of claim 1 further comprising an opening in a side of the floor level tank receiving the fluid and waste from the outlet of the rear outlet toilet and one or more inlets located in a side or a back of the tank chamber for receiving fluid and/or waste from other sources than the rear outlet toilet.

11. The system of claim 1 further comprising an alarm system secured to an inside surface of the tank chamber of the floor level tank for sensing a high level of the fluid and waste within the tank chamber.

12. The system of claim 10 wherein a portion of the floor of the tank chamber near an inlet is curved.

13. An aboveground waste collection and disposal unit comprising an above, floor level tank for receiving waste from a rear outlet of a rear outlet toilet, wherein the toilet is located on the floor, wherein the tank comprises a tank chamber containing a designated area containing a sensing system designed to sense fluid or waste within the tank chamber, which system is capable of activating a discharge pump when the level of waste within the tank chamber reaches a predetermined level, wherein the tank chamber further comprises a baffle extending upward from a floor of the tank chamber which at least partially segregates the designated area from the remaining area within the tank chamber, wherein the level of the floor of the tank chamber descends as it approaches the discharge pump, and wherein the floor of the tank chamber further comprises a series of descending steps, wherein the above-floor level tank is located behind the rear outlet toilet and on the floor, wherein the toilet is not on top of the tank, and wherein the rear outlet toilet and the above-floor level tank are both supported by the floor and do not disrupt the floor.

14. The unit of claim 13 wherein the baffle contains a curved surface.

15. The unit of claim 13 further comprising one or more additional baffles extending upward from the floor of the tank chamber, wherein at least one of said additional baffles does not contain a curved surface.

16. The unit of claim 15 wherein at least two of the baffles overlap.

17. The unit of claim 13 wherein a portion of the floor of the tank near an inlet is curved.

18. The unit of claim 13 further comprising an alarm system for sensing a high level of the fluid and waste present within the tank chamber.

19. The system of claim 13 further comprising an adjustable attachment system for attaching the floor level tank to the outlet of toilets with varying outlet heights.

20. An aboveground waste collection and disposal unit comprising an above, floor level tank for receiving fluid and waste from a rear outlet of a rear outlet toilet, wherein the toilet is located on the floor, wherein the tank comprises a tank chamber containing a designated area therein, wherein the area contains a float system which is capable of activating a discharge pump when the level of fluid and waste within the tank chamber reaches a predetermined level, wherein the chamber further comprises a plurality of baffles extending upward from a floor of the tank chamber which at least partially segregates the designated area from the remaining area within the tank chamber, wherein the level of the floor of the tank chamber descends as it approaches the discharge pump, and wherein the floor of the tank chamber further comprises a series of descending steps, wherein the above-floor level tank is located behind the rear outlet toilet and on the floor, wherein the toilet is not on top of or above the tank, and wherein the rear outlet toilet and the above-floor level tank are both supported by the floor and do not disrupt the floor.

21. The unit of claim 20 wherein at least two of the baffles overlap.

22. The unit of claim 20 further comprising an adjustable attachment system for attaching the floor level tank to the outlet of toilets with varying outlet heights.

23. The unit of claim 20 wherein the plurality of baffles includes a baffle with a curved surface.

24. The unit of claim 20 further comprising an alarm system for sensing the level of fluid and waste within the tank chamber.

* * * * *